US005885117A

United States Patent [19]

Cvasa

[11] Patent Number: 5,885,117

[45] Date of Patent: Mar. 23, 1999

[54] ONE-PART CONTACT ELEMENT

[75] Inventor: Eduard Cvasa, Wuppertal, Germany

[73] Assignee: Delphi Automotive Systems Deutschland GmbH, Wuppertal, Germany

[21] Appl. No.: 766,547

[22] Filed: Dec. 11, 1996

[30] Foreign Application Priority Data

Dec. 22, 1995 [DE] Germany ..... 195 48 168.2

[51] Int. Cl.[6] ..... H01R 11/22

[52] U.S. Cl. ..... 439/848; 439/125

[58] Field of Search ..... 439/851, 852, 439/843, 845, 381, 848, 125–128

[56] References Cited

U.S. PATENT DOCUMENTS

| | | | |
|---|---|---|---|
| 3,246,284 | 4/1966 | Farison | 439/848 X |
| 3,546,665 | 12/1970 | Zak | 439/848 X |
| 3,771,113 | 11/1973 | Cronce | 439/848 R |
| 3,793,616 | 2/1974 | Moehrke . | |
| 4,136,922 | 1/1979 | Grebik . | |
| 4,540,236 | 9/1985 | Peers-Trevarton | 439/848 X |

FOREIGN PATENT DOCUMENTS

| | | |
|---|---|---|
| 0133094 | 2/1985 | European Pat. Off. . |
| 8313411 | 9/1983 | Germany . |

*Primary Examiner*—Paula Bradley
*Assistant Examiner*—Daniel Wittels
*Attorney, Agent, or Firm*—Cary W. Brooks

[57] ABSTRACT

In order to produce a one-part contact element (1) for connection of an ignition cable to a spark plug connector which is inexpensive and enables a non-releasable connection, an embracing tongue (11) is formed on one of two oppositely arranged edges (9, 10) of a sleeve (8) and on the side edge (22) of a bent-up catch (12) of the tongue (11) facing the spark plug connector is stamped out a recess (17) delimited by side edges (25, 26).

8 Claims, 5 Drawing Sheets

ONE-PART CONTACT ELEMENT

TECHNICAL FIELD

The invention starts out from a one-part contact element.

BACKGROUND OF THE INVENTION

Such a one-part contact element is known from the EP 0 133 094 B1. This describes a connecting terminal whose one end region is to be connected to a connecting cable, while the other connecting region serves to receive a plug pin, e.g. from a spark plug or a spark plug connector. For joining to the end of the connecting cable, a ferrule situated in the end region of the connecting terminal is clipped onto the insulating sheath and the insulation-free end of the cable and crimped onto it. This ferrule is followed by a helically wound bush which can be clipped onto a contact pin of the operational element (spark plug, spark plug connector). For this purpose the contact pin of the operational element has a groove into which can snap a hook projecting from outside through apertures in the windings of the contact bush. During the clip-on process the contact bush springs up so that, after the snapping in, it can again return to its original circumference.

Such an arrangement is advantageous as it ensures a secure contact between the connecting cable and the electric operational element and the one-part connecting terminal allows for economical manufacture.

The drawback however is that because of the releasability of the catch, it cannot be used as a contact element between an ignition cable and a spark plug connector. Non-releasable contact elements are used in prefabricated spark plug connectors for connecting the ignition cable, i.e. spark plug connectors which are encased in a spray coated insulation layer. The link between the contact bush and the spark plug connector must therefore be so resistant that when the plug arrangement constructed in this way is subjected to tensile forces, only the spark plug connector becomes separated from the spark plug, as required for servicing.

In the DE 8313411 U1 is disclosed an arrangement in which a bush can be clipped to a contact pin of a spark plug connector and is non-releasably snap-corrected thereto. For this the contact pin of the operational element has a snap-in groove into which can snap a spring washer of the connecting bush of the connecting cable. The spring washer is trapezoidal in design and a substantial part of its circumference lies outside in a groove of the connecting bush. The straight segment of the spring washer penetrates a radial opening of the bush and projects with one part of its circumference beyond the inner sheath of the bush. The segment serves for snap connection in a corresponding groove of the contact pin. During the manufacture of the contact bush, the spring washer is received in the arrangement as a separate part. This multiplicity of parts in the contact bush increases the manufacturing cost and is therefore undesirable.

SUMMARY OF THE INVENTION

Starting out from the state of the art referred to at the beginning, it is the object of the invention to produce a contact element of the generic type which is inexpensive and which permits a non-releasable connection between the connecting cable and the spark plug connector which can be quickly and reliably manufactured.

It is proposed to use the catch both for the usual securing against axial stress as well as, according to the invention, for securing against radial stress. On the one hand such a securing takes place by mutual stopping of catch and side wall in the groove and on the other hand by an additional recess. This recess ensures that the link between the contact element and the spark plug connector is maintained even when subjected to radial stress. The recess is located in the side edge of the bent-up hook facing the spark plug connector. When this link is radially stressed, the recess is pressed against the inner edge of the aperture facing the spark plug connector, so that the sleeve can spring back only over the length between the side edges of the recess. The recess is so dimensioned that the connection reacts elastically to natural stresses. However, the catch remain engaged with the groove to such an extent that release of the connection is not possible.

The connection is of course secured also against axial stresses. When subjected to axial stress, the catch with its edge situated opposite the recess abuts against a side wall of the groove, so that a corresponding resistance blocks a traction movement. This feature is a necessary requirement for such an arrangement comprising of a connecting cable, a contact element and a spark plug connector. In order to withstand the repeated clipping on and pulling off the spark plug, the connections between these three elements must be substantially more stable than the connection between this arrangement and a spark plug. Such arrangements are used when the spark plug connector is first encased with an insulation sheath and the ignition cable is only subsequently contacted.

It is particularly advantageous when the contact pin of the spark plug connector has a slide-in aid. Since the connecting region between the contact element and the spark plug connector is located within the insulation sheath and cannot therefore be optically controlled, such a clip-on slope enables an unproblematic assembly.

A further aid for ensuring a secure connection is provided by an acoustic signal. The spring force which is released during the snapping-in of the catch in the groove of the spark plug connector is such that a clicking sound can be heard. The spring force can be adjusted by the length of the tongue supporting the catch and is optimal so long as the tongue embraces half of the sleeve and engages in a corresponding aperture of the sleeve. When the tongue is shorter, the elasticity is reduced, whilst a longer tongue causes the manufacturing costs for forming the sleeve to be increased.

The width of the aperture in which the catch moves is so defined that a spring back during the clip-on process is possible, but at the same time is prevented, that the contact element can be slipped onto a contact pin of the spark plug connector which does not correspond to the circumference of the sleeve. The aperture also absorbs finishing tolerances. The width of the aperture may for example apply to the sleeve circumference and may amount to 1/10 of it.

The catch is so dimensioned that it constantly engages sufficiently deeply in the groove of the contact pin, i.e. even during radial spring back of the sleeve corresponding to the length of the recess.

The catch serves only as a secondary function to transmit the current from the contact element to the spark plug connector. The electric contact takes place in the areas of the sleeve's inner surface which are directly contacted by the contact pin. Accordingly a radial contact zone exists in each case on both sides of the groove, which contact zone is arranged between the contact pin and the contact sleeve. So that these contact surfaces are present over the entire circumference of the sleeve, the edges of the sleeve contact each other directly on the seam. In order to ensure a smooth transfer, this continuous seam on the outlet point of the tongue requires from one of the contact edges a corresponding recess in the opposite contact edge. From a manufacturing point of view this can easily be realised and supports the spring action of the tongue.

BRIEF DESCRIPTION OF THE INVENTION

The invention is now explained with the aid of an embodiment example and with the help of the drawings.

Figure 3:
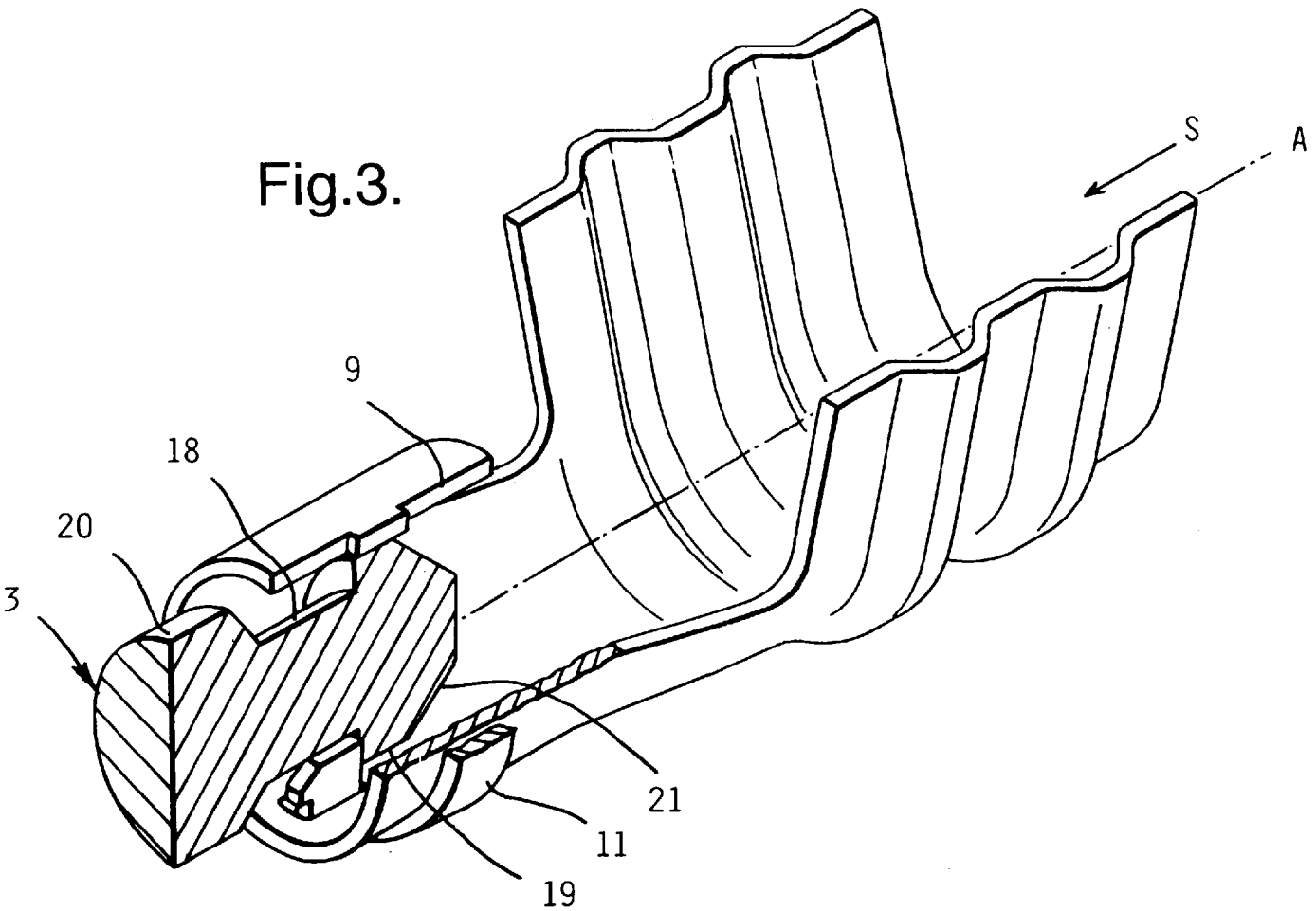
Figure 4A:
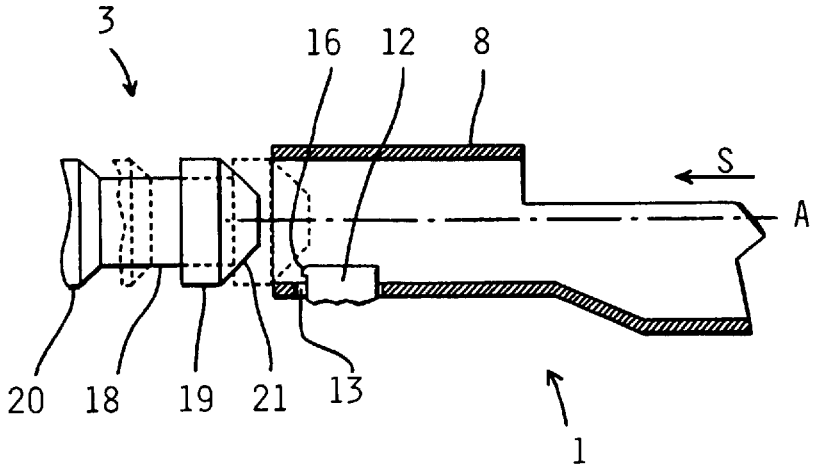
Figure 4B:
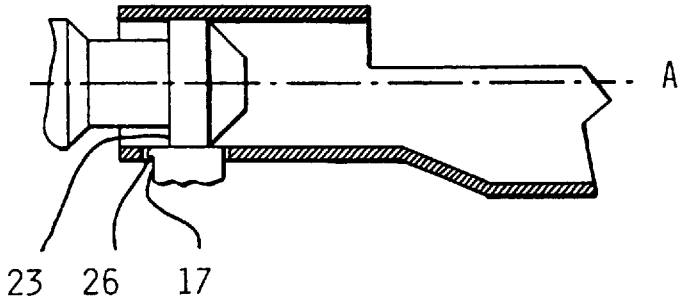
Figure 4C:
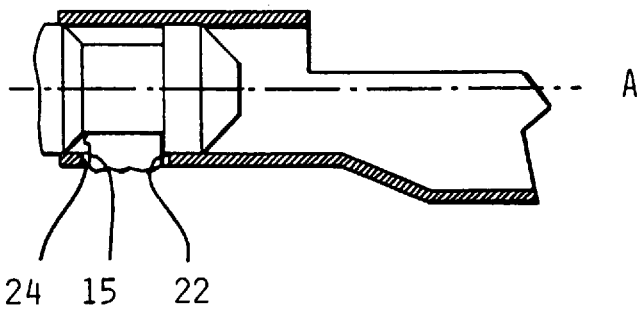
Figure 5:
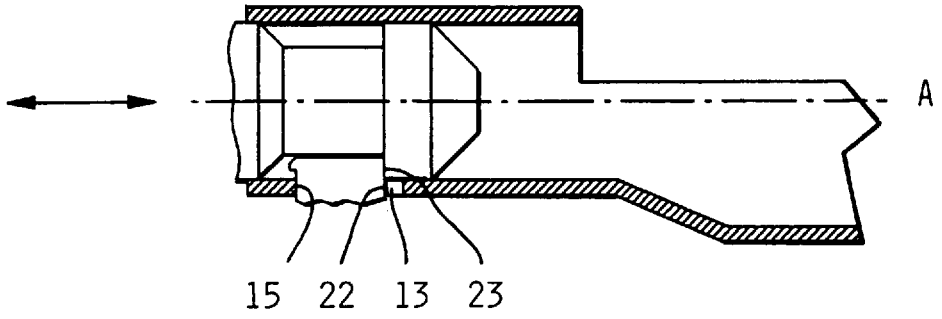
Figure 6:
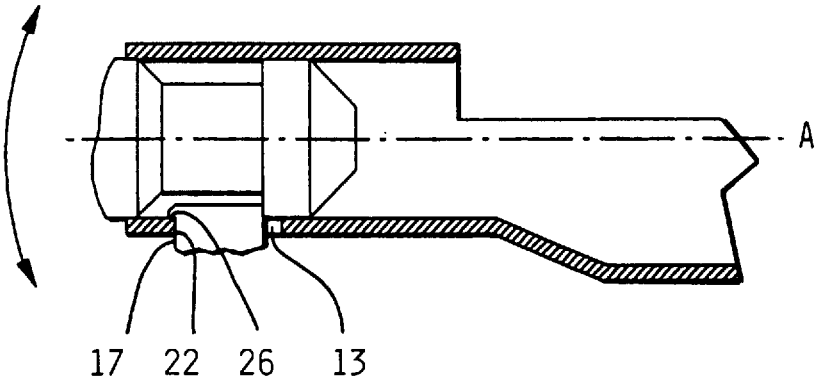

FIG. 3 a perspective view of the contact element, cut in the area of the sleeve, with a clipped-in contact pin of the spark plug connector;

FIG. 4*a–c* the clipping-on of the contact element on the contact pin;

FIG. 5 an axial stress on the connection between contact element and contact pin;

FIG. 6 a radial stress on the connection between contact element and contact pin.

DESCRIPTION OF THE PREFERRED EMBODIMENT

Figure 1:
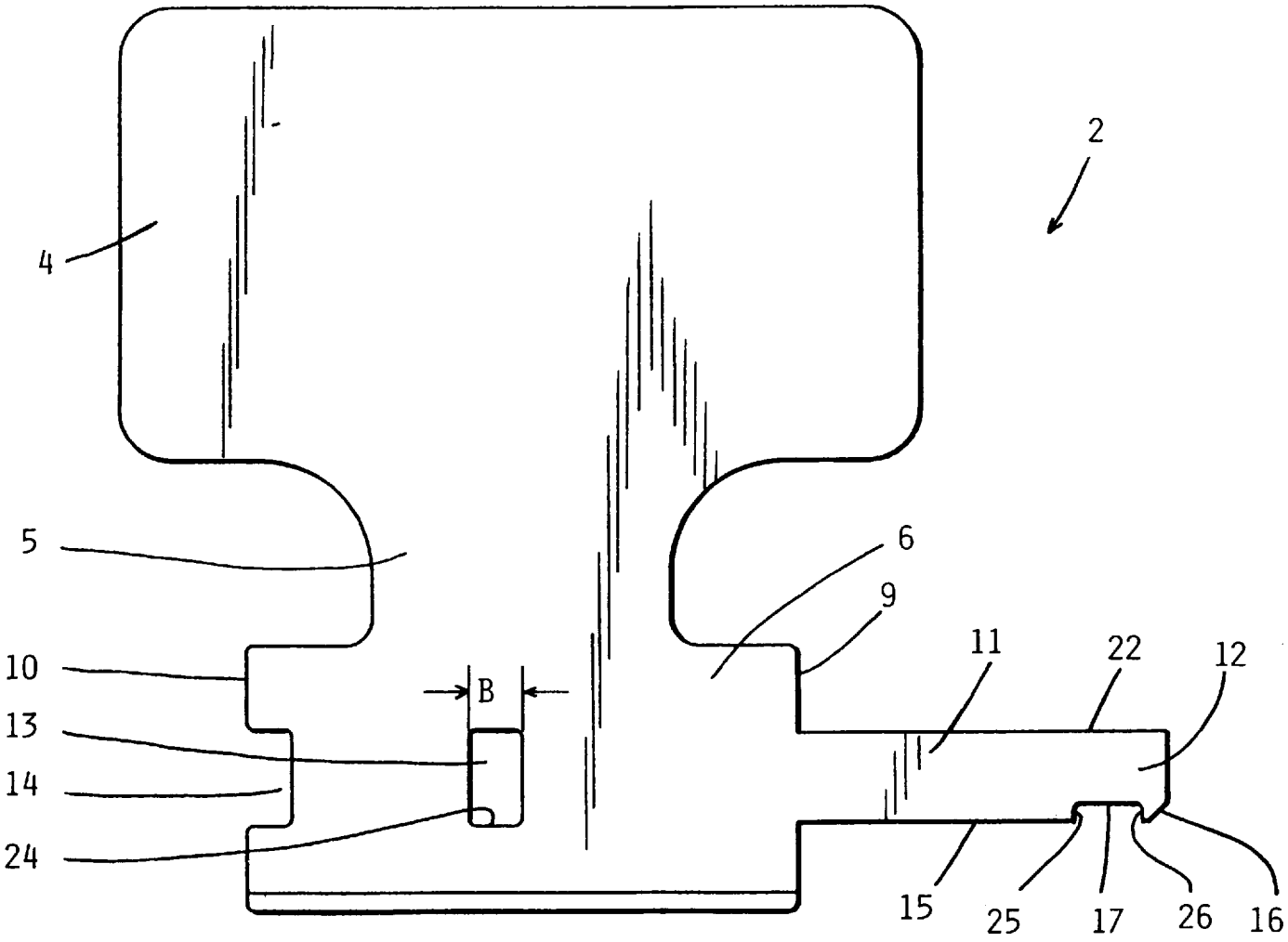
FIG. 1 shows a blank of the contact element.
Figure 2:
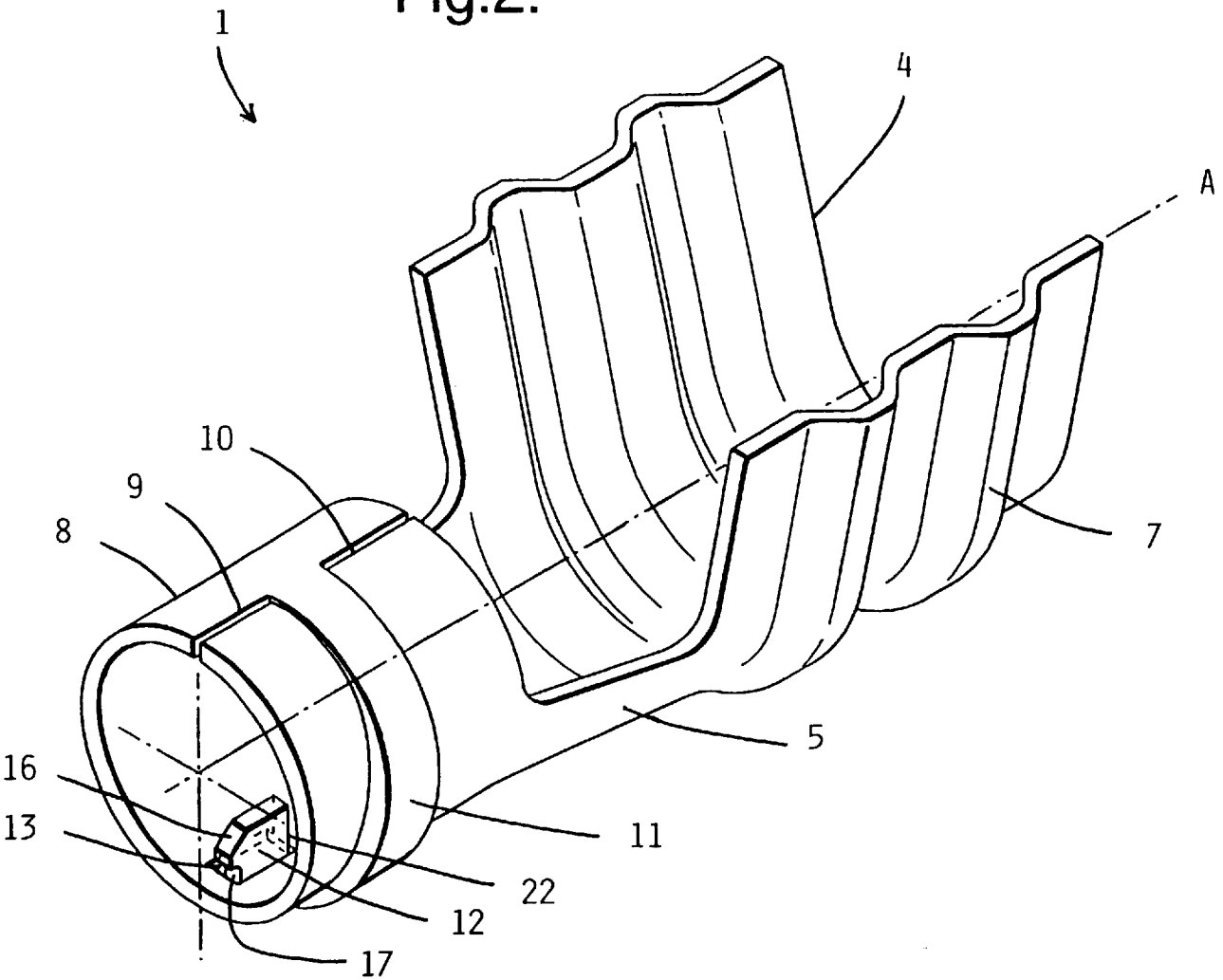
FIG. 2 shows a perspective view of the contact element bent to the finished version from the blank in FIG. 1.

The drawings are shown according to various different scales. A contact element 1 is manufactured in one piece from a spring-elastic material, wherein a blank 2 according to FIG. 1 is stamped out of a metal sheet. The actual dimensions may be for example 25 mm in length of the contact element 1 and 5 mm in cross-section. Through various shaping method from this blank 2 is subsequently produced the contact element 1. The contact element 1 shown is limited to the basic representation of the connection between the contact element 1 and a contact pin 3 of a spark plug connector (not shown). The detailed representation and description of a crimp section 4 and an ignition cable to be attached therein was deliberately omitted. Such a contact element 1 together with the ignition cable and the spark plug connector forms an arrangement which contacts the spark plug. The spark plug connector is first spray coated with an insulation sheath and subsequently the contact element 1 with the crimped-on cable is clipped on. Such spark plug connectors which are indirectly connected to the ignition cable have the advantage over spark plug connectors which are directly connected to the ignition cable that the unit can be more easily sealed.

In the working condition as blank 2 the contact element 1 has a rectangular crimp section 4 which through a bridge 5 is connected in one part with a rectangular clip-on section 6. The blank 2 is bent around a longitudinal axis A to form a contact element 2 ready to be assembled. The crimp section 4 is formed into a half shell which is provided with corrugations 7 for increasing the strengthening properties between ignition cable and contact element 1. The clip-on section 6 is bent to form a closed sleeve 8 so that that the two lateral edges 9 and 10 abut against each other. On the edge 9 is formed a tongue 10 which resiliently embraces half the circumference of the sleeve 8 and with a catch 12 engages in an aperture 13 of the sleeve 8. A recess 14 in the edge 10 ensures that the sleeve 8 is embraced in a continuous transition from the edge 9. The tongue 11 ends in the catch 12 which is bent up at right angles and which has a slope 16 and a recess 17 in its lateral edge 15 in the clip-on direction S. The aperture 13 receives the catch 12 and permits a radial deflection of the catch 12 or the tongue 11 by 1/10 of the sleeve circumference.

A contact pin 3 of a spark plug connector corresponding to the sleeve dimensions can be slid into the contact element 1 and snap connected therein. A groove 18 separates the contact pin 3 into two contact areas 19 and 20. The forward contact area 19 ends in a radially arranged sloping slide-in aid 21.

In the following are described the sequence of movement involved in the connection of the contact element 1 with the contact pin 3 (Fig. 4*a–c*). The introduction of the contact element 3 into the sleeve 8 is made easier by the sliding together of the slide-in aid 21 and the slope 16. This causes the catch 12 to be pushed out of the sleeve 8. This movement causes the tongue 11 to give way spring-elastically within the frame of the width B of the aperture and causes a slight enlargement of the circumference of the sleeve 8. The contact pin 3 can be completely introduced into the sleeve 8. This movement process is ended by the snapping-in of the catch 12 in the groove 18 and is indicated by an acoustic signal.

When this connection is subjected to axial stress, the side edge 22 of the catch 12 strikes a side wall 23 of the groove 18 and displaces the tongue 11 including the recess 17 against an inside edge 24 of the aperture 13. This prevents the contact pin 3 from being ripped out of the sleeve 8. Apart from the aforementioned sequence of movements, movement in the circumferential direction causes radial stress on the sleeve. The radial deflection of the tongue 11 caused by this is limited by side edges 25 and 26 of the recess 17 so that in this case the contact pin 3 remains in the sleeve. In order to ensure in every case a sufficient interlocking between the catch 12 and the groove 18, the height of the catch 12 is approximately three times the material thickness of the contact element 1. The assembly of the contact element 1 with a contact pin 3 which is too big is not possible, as the spring path of the tongue 11 is limited by the width B of the aperture and this also sets the maximum circumferential expansion of the sleeve 8.

The current flow takes place in the clip-on section 6 between the sleeve 8 and the contact region 19 and 20 of the contact pin 3. The ridgeless embracing of the sleeve 8 by the tongue 11 contributes towards the optimisation of the contacting zone, as this results in a perfect contact of the contact pin 3 in the area where the edges 9 and 10 abut against each other.

The contact element 1 allows for a connection to be made with a contact pin 3 of a spark plug connector which is secure and non-releasable. The connection can withstand assembly stresses of both a radial as well as an axial nature, so that the separation of the entire system always takes place between the spark plug connector and the spark plug. Furthermore, the tearing forces of the entire system are such that in the event of stress caused by a fault or an askew fit, the connection between the ignition cable and the crimp section 4 of the contact element 1 is split open.

I claim:

1. One-part contact element (1) stamped out of a metal sheet and bent for connection of an ignition cable to a spark plug connector, having a crimp section (4) for the permanent attachment of the ignition cable, which is bent to a U-shape, and having a clip-on section (6), bent to form a sleeve (8) and linked via a bridge (5) to the crimp section (4), for connecting the contact element (1) to the spark plug connector, characterised in that on one of the oppositely arranged abutting edges (9, 10) of the sleeve (8) is formed a tongue (11) which embraces the sleeve (8) and which has a catch (12) which non-releasably engages in an aperture (13) of the sleeve (8), and in that on the side edge (15) of the catch (12) directed away from the crimp section (4) is stamped a recess (17) delimited by the side edges (25, 26).

2. One-part contact element according to claim 1, wherein on the side edge (15) is formed a slope (16).

3. One-part contact element according to claim 1, wherein the tongue (11) embraces the sleeve (8) over half its circumference.

4. One-part contact element according to claim 1, wherein the width (B) of the aperture (13) is so defined that limited expansion of the sleeve (8) during connection with the spark plug connector is possible.

5. One-part contact element according to claim 1, wherein the width (B) of the aperture (13) is at least 1/20 of the sleeve circumference.

6. One-part contact element according to claim 1, wherein the sleeve (8) is dimensioned to contact a contact pin (3) of the spark plug connector over its entire circumference.

7. One-part contact element according to claim 1, wherein the recess (17) has at least double the material strength of the contact element (1) in the longitudinal direction.

8. One-part contact element according to claim 1, wherein the crimp section (4) has a corrugated profile (7) in the transverse direction.

* * * * *